United States Patent [19]

Ottemann et al.

[11] Patent Number: 4,921,219

[45] Date of Patent: May 1, 1990

[54] POWERED SAILBOAT WINCH

[75] Inventors: William C. Ottemann, Fremont; Richard A. Gabellini, Aptos, both of Calif.

[73] Assignee: IMI-Barient, Inc., Guilford, Conn.

[21] Appl. No.: 403,997

[22] Filed: Sep. 5, 1989

Related U.S. Application Data

[63] Continuation of Ser. No. 181,005, Apr. 13, 1988, abandoned.

[51] Int. Cl.[5] ..... B66D 1/08

[52] U.S. Cl. ..... 254/284; 254/291; 254/344; 1921/48.92

[58] Field of Search ..... 254/274, 284, 285, 290, 254/291, 293, 335, 336, 340, 342, 344, 361, 382; 74/785, 661, 677; 192/48.92, 0.098; 242/86.51

[56] References Cited

U.S. PATENT DOCUMENTS

| | | | |
|---|---|---|---|
| 1,792,092 | 2/1931 | Holmes | 74/785 X |
| 3,606,257 | 9/1971 | Wilson | 254/290 X |
| 3,698,690 | 10/1972 | Beaver | 254/361 X |
| 4,136,855 | 1/1979 | Morrow | 254/361 |
| 4,223,871 | 9/1980 | Braithwaite | 254/291 |
| 4,234,167 | 11/1980 | Lane | 254/291 |
| 4,434,972 | 3/1984 | Charles | 254/361 X |

OTHER PUBLICATIONS

Seaway Products Hydralic Systems, Issue 1, Seaway Products Ltd., the Hydraulic Centre, Tregoniggie Industrial Estate, Falmouth, Cornwall, TR11 4SN, UK.

*Primary Examiner*—Katherine A. Matecki

*Attorney, Agent, or Firm*—Townsend and Townsend

[57] ABSTRACT

A power sailboat winch mechanism for the high speed gathering of running rigging line under initial low tension with final slow speed gathering of the same line under final high tension combined with line storage is disclosed. The winch mechanism includes two drums handling the line in series, these drums constituting a winding drum and a high torque drum. The winding drum is provided threaded to the bitter end of the line with a level wind for even distribution of the line along the drum. This winding drum provides initial rapid line take-up, tailing force to a high torque winch drum and line storage for the requisite amount of line used in the particular running rigging handled by the winch. A conventional high torque winch drum is provided between the winding drum and line load. This high torque winch is provided with surfaces to induce line climbing of the drum by conventional crowd climbing over the drum surface. This high torque winch spins free on a ratchet during high speed line gathering at the take-up drum, provides low speed high torque ouput for required final running rigging tensioning and has a proportional clutch release for letting line go under controlled tension for working of the running rigging.

6 Claims, 5 Drawing Sheets

POWERED SAILBOAT WINCH

This is a continuation of Ser. No. 181,005, filed Apr. 13, 1988, now abandoned.

BACKGROUND OF THE INVENTION

This invention relates to sailboat winches. More particularly, a winch for the high speed low tension take-up and final low speed high tension handling of running rigging on Genoa jibs of large Marconi rigged sailboats is disclosed.

SUMMARY OF THE PRIOR ART

Large sailboats have not been able to accommodate conventionally powered winches. Taking the case of a boat in the order of 120 feet in length with a 150 foot mast Marconi rig with a Genoa jib, the automated handling of the jib sheets presents a problem. This problem is not capable of conventional handling by known powered winches.

A Marconi rig sailboat has the conventional triangular sails. Typically, the Genoa jib fastens to a fore stay. The fore stay runs from the top of the mast to the tip of the bow of the boat.

The Genoa jib is a large triangular sail. This sail often exceeds the size of the so-called "main sail". This being the case, the tensioning of this sail at its extreme point or "clew" from the boat presents a problem not accommodated by modern powered winches.

Most powered take-ups of running line which include line storage are provided by a conventional winding drum with a level wind. A good example of such a drum and level wind is the conventional fishing reel. The drum rotates for line take-up. Usually this rotation is under constant tension at a drum brake. Where the tension is exceeded, the brake no longer permits the line to be taken in.

The level wind makes sure that line stored on the drum is level. Simply stated, the level wind under an endless thread on a rotating shaft makes excursion back and forth across the drum. Line is threaded through the level wind. The combination of the excursion of the line and the winding of the drum produces on the wound drum a "level wind" of line stored on the drum.

This arrangement is completely unsatisfactory for handling the jib sheet on a large sailboat. In order to understand the failing of such a level wind device, one must understand the bringing in of a Genoa jib by a sheet on a Marconi rigged sloop, the sloop being close hauled to the wind. Such "working" of sail is required where the vessel "comes about" or "tacks," head to wind.

In such a "tack," the boat changes its angle of attack to the wind so that the oncoming wind initially incident on one side of the Genoa jib becomes incident on the opposite side of the Genoa jib. By shore side standards, unusual line handling problems are presented.

First, the sheet attached to such a Genoa jib on a Marconi rigged sloop is long. It must have sufficient length to pass from the winch on one side of the vessel, around the mast and back to the clew of the sail when the sail is close hauled at the opposite side of the vessel. In short, a length of line must be used on such a winch to extend from one winch around the mast all the way back to the remaining winch. Further, and when the vessel is running "before the wind" further extension of the sheet may be required. In the case of a 120 foot Marconi rigged sloop with a 150 foot mast mentioned above, at least 150 feet of 1 inch line must be used.

Second, the tension on the line is far from uniform when it is brought in during a tack.

During a tack, as the vessel moves head to wind, the sail is initially cut loose by letting out the line or sheet attached to the Genoa jib on one side of the vessel. The line or sheet attached to the Genoa jib on the opposite side of the vessel must be rapidly gathered in under low tension to the winch on the opposite side of the vessel. When the line is gathered in under low tension, the base or low lying wraps of the winch drum are soft. They are wrapped loosely over one another. In the case of the boat mentioned above, the tensions of the initial winds will be far less than 1,000 lbs.

Conversely, when the sail is finely tensioned, the sheet is given extreme tension. This is so that the Genoa jib provides the correct shape to the wind. When it is remembered that Genoa's jib are essentially air foils and that they are sculpted by tension with respect to the onrushing wind, the purpose of this tension can be understood. Further, such sculpting of the sail requires increased tension with increased winds. Tensions in the order of 20,000 lbs. on a 1 inch line may ultimately be required.

Returning to the case of the conventional level wind, and remembering that the initial winds constituting the bulk of the inner wound rope mass on the drums are soft, the problem of line accumulation becomes apparent. The hard winds under great tension will be on the outside of this soft rope mass. These hard winds will sink deeply into and fowl with the previous soft winds on the drum. Hopeless fowling of the line and loss of the ability to work the attached Genoa jib would result. A dangerous unacceptable condition would be present.

There does exist a class of winch mechanisms used for taking in line under great tension. These mechanisms usually include for the high torque winches a pair of simultaneously rotating drums. These simultaneously rotating drums receive the portion of the line under great tension and discharge the line to a conventional take-up drum, usually equipped with a level wind.

The simultaneously rotating drums of the high torque winch are spaced side-by-side and turn on parallel axes. Each of the drums is circumscribed with a series of grooves, typically V-grooves.

Threading of the line to such high torque drums can be easily understood. Line is threaded in a spiral. The spiral is wound about one half of one drum and then the remaining half of the other drum. Typically, the line is wound around one half of one drum at one of the V-grooves. The line is then passed to the adjacent drum and wound around the other half of the other drum at a similar V-groove. The line is then returned to the former drum and wound about an identical drum half at an adjacent and typically lower groove. This spiral winding process continues about successive halves of each drum until sufficient turns have been taken around both drums at successive V-grooves to produce the required tension.

The concept is sound. Line can reliably be brought in under high tension. However, the problem when applied to a Marconi rigged sailboat is speed. Line handling by these kinds of winches is unacceptably slow. Further, on these types of winch mechanisms, the larger the ultimate tension and the larger the line, the slower the winch operation. This problem of speed extends both to the taking in and the letting go of line. The relation of this problem of speed to the large sailboat example which we are using here can be instructive.

Anyone who has watched a Marconi rigged sailboat with a Genoa jib knows that when such vessels tack head to wind they are characterized by the luffing (or flapping) when the so-called "tack" occurs. The sail can be seen to move violently with wind induced ripples. The characteristic flapping noise can be heard a long distance from the boat during the tacking maneuver. Unfortunately, the experienced sailor knows that there is more to this flapping than originally meets the eye.

Simply stated, if sails are allowed to flap or luff long enough they literally tear themselves apart. The higher the wind, the more damaging the luff. Further, the larger the sail the more rapidly damage is imparted to the sail.

Modern racing yachts are typically equipped with synthetic racing sails. These sails, while adding speed to the boat, are particularly sensitive to being damaged by luffing. Consequently, it is absolutely required that slack be immediately taken up to prevent immediate sail damage or short term sail failure.

For these reasons, presently known winch designs are simply not practical for the powered operation of a large sailboat. This is especially true at running sheets attached to Genoa jibs of large sailboats.

SUMMARY OF THE INVENTION

A power sailboat winch mechanism for the high speed gathering of running rigging line under initial low tension with final slow speed gathering of the same line under final high tension combined with line storage is disclosed. The winch mechanism includes two drums handling the line in series, these drums constituting a winding drum and a high torque drum. The winding drum is provided threaded to the bitter end of the line with a level wind for even distribution of the line along the drum. This winding drum provides initial rapid line take-up, tailing force to a high torque winch drum and line storage for the requisite amount of line used in the particular running rigging handled by the winch. A conventional high torque winch drum is provided between the winding drum and line load. This high torque winch is provided with surfaces to induce line climbing of the drum by conventional crowd climbing over the drum surface. This high torque winch spins free on a ratchet during high speed line gathering at the take-up drum, provides low speed high torque output for required final running rigging tensioning and has a proportional clutch release for letting line go under controlled tension for working of the running rigging. A three speed hydraulic circuit with three hydraulic motors capable of running in parallel for high torque powered operation of the winch is disclosed. A first motor powers the winding drum, runs alone for initial rapid line take-up and sequences the next in series hydraulic motor when drum torque and hence hydraulic inlet pressure to the motor exceeds a preset limit. The second hydraulic motor drives the high torque drum at a medium torque speed in parallel with the winding drum driven by its hydraulic motor in a tailing mode. This second motor in turn sequences a third motor driving the high torque drum in parallel. Final tensioning is provided by all three motors driving in parallel. The hydraulic circuit releases a proportionally controlled clutch on each drum for controlled release of the running rigging.

Other Objects, Features and Advantages

An object to this invention is to set forth a combination of winch drums which together can work under power and acceptably store running rigging on the Genoa jib of a large sailboat. A take-up drum is provided threaded to the bitter end of the Genoa jib sheet. This take-up drum provides line storage, initial take-up tension for the prevention of undue sail luffing and tail tensioning of a high torque winch drum. A high torque winch drum is provided in series on the line between the take-up drum and Genoa jib line load. The high torque winch drum has conventional crowd climbing cams on the barrel surface of the winch so that high tension take-up occurs at one side of the drum with tailing tension line release at the other side of the drum. A level wind intermediate the two drums assures even line storage on the take-up drum.

An advantage of this combination is that the high torque drum can free wheel under a ratchet during rapid take-up of the bulk of the line. Consequently, the high torque drum does not interfere with the rapid gathering of the line to prevent undue sail luffing.

Yet another advantage is that the winding drum and level wind provide three discrete functions.

First, sufficient line can be stored on the winding drum to enable full working of sail.

Second, rapid winding is provided for rapid take-up to prevent undue sail luffing with resultant sail damage.

Finally, the winding drum acts in a tailing capacity to the high torque drum.

An advantage of the winding drum being placed at the bitter end of the line in series behind the high torque drum is that the winding drum receives substantially constant tension. Thus, all winds stored on the drum will be wound under substantially constant tension. Cutting of a "hard" outer wind into a lower "soft" wind is eliminated.

An additional object of this invention is to disclose the placement of a high torque drum in series with the winding drum so that the variable speed and variable tension take-up problems of a conventional Genoa jib sheet can be accommodated. Accordingly, a high torque winch is placed on the line in series with the load between the loaded end of the line and the winding drum. This high torque winch is provided with pair climbing cams at either side of the drum to enable centering of the line during both line take-up and line release. The winch is driven by at least one and preferably two hydraulic motors under high torque. At the same time, and in order to assure rapid line take-up, the high torque winch is capable of free turning on a ratchet. Further, letting go of the high torque winch is provided at a clutch. The clutch here illustrated attach as to the outer ring of a planetary gear drive.

An advantage of this aspect of the invention is that the high torque winch only becomes active when high line tension is required. At other times, the winch runs free with the line enabling the required rapid gathering of the line.

A further advantage of the high torque winch is that it can be driven by two separate motors. One of these motors can drive the high torque drum at intermediate tension with the final motor geared to drive the high torque drum at full tension.

A further object to this invention is to set forth a hydraulic circuit for utilization with the disclosed winch mechanism. The winding drum is driven by a hydraulic motor. The inlet pressure to the hydraulic motor is a direct function of the tension encountered at the winding drum. When the inlet hydraulic pressure to the motor reaches a preset level—in the order of 1200 psi—a conventional hydraulic sequencing circuit runs a second motor attached to the high torque drum in parallel with the winding drum.

This second motor driving the high torque drum in turns sequences a third motor at 1500 psi hydraulic pressure. When the third motor is sequenced, all three motors run in parallel to effect low speed high tension line take-up.

An advantage of the disclosed hydraulic circuit is that its required shifting to high torque and low speed take-up is solely a function of line tension. This line tension, serially sensed by the input to the first and second hydraulic motors, enables winch torque responsive to the ever changing dynamics of weather, sail, sea and angle of attack of the vessel to the wind.

An additional object to this invention is to set forth a winch mechanism that enables rapid release of gathered line. According to this aspect of the invention, the take-up drum is provided with a conventional clutch release which upon release only exerts a small torque. The high torque drum is provided with a dual planetary gear drive wherein one of the outer rings of the planetary gear has a normally engaged clutch. Proportional hydraulics act against the normal clutch or brake engagement to effect clutch or brake release. Consequently, a proportional release of the line can occur that emulates a manual tailed release of line from a conventional modern winch.

An advantage of this aspect of the invention is that controlled line release is possible. For example, the tension on the sheet can be eased responsive to either slackening wind or change of angle of attack to the wind. Alternately, rapid and complete line release can occur for working the sail as in a tack. In short, for the first time, the characteristics of a manually tailed modern winch has been automated for line handling on large vessels.

BRIEF DESCRIPTION OF THE DRAWINGS

Other objects, features and advantages of this invention will become more apparent after referring to the following specification and attached drawings in which.

DETAILED DESCRIPTION OF THE INVENTION

Figure 1:
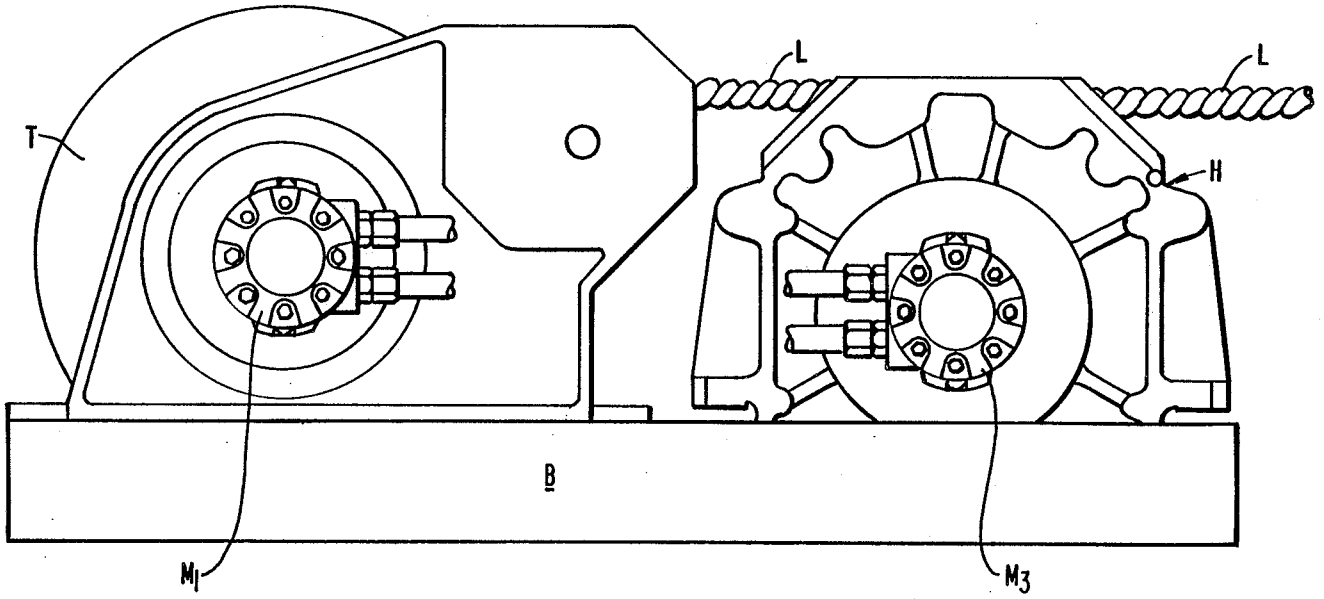
FIG. 1 is a side elevation of the disclosed winch illustrating the winding drum at the bitter end of the line with the high torque drum placed in series on the line between the line load and the working end of the line.
Figure 2:
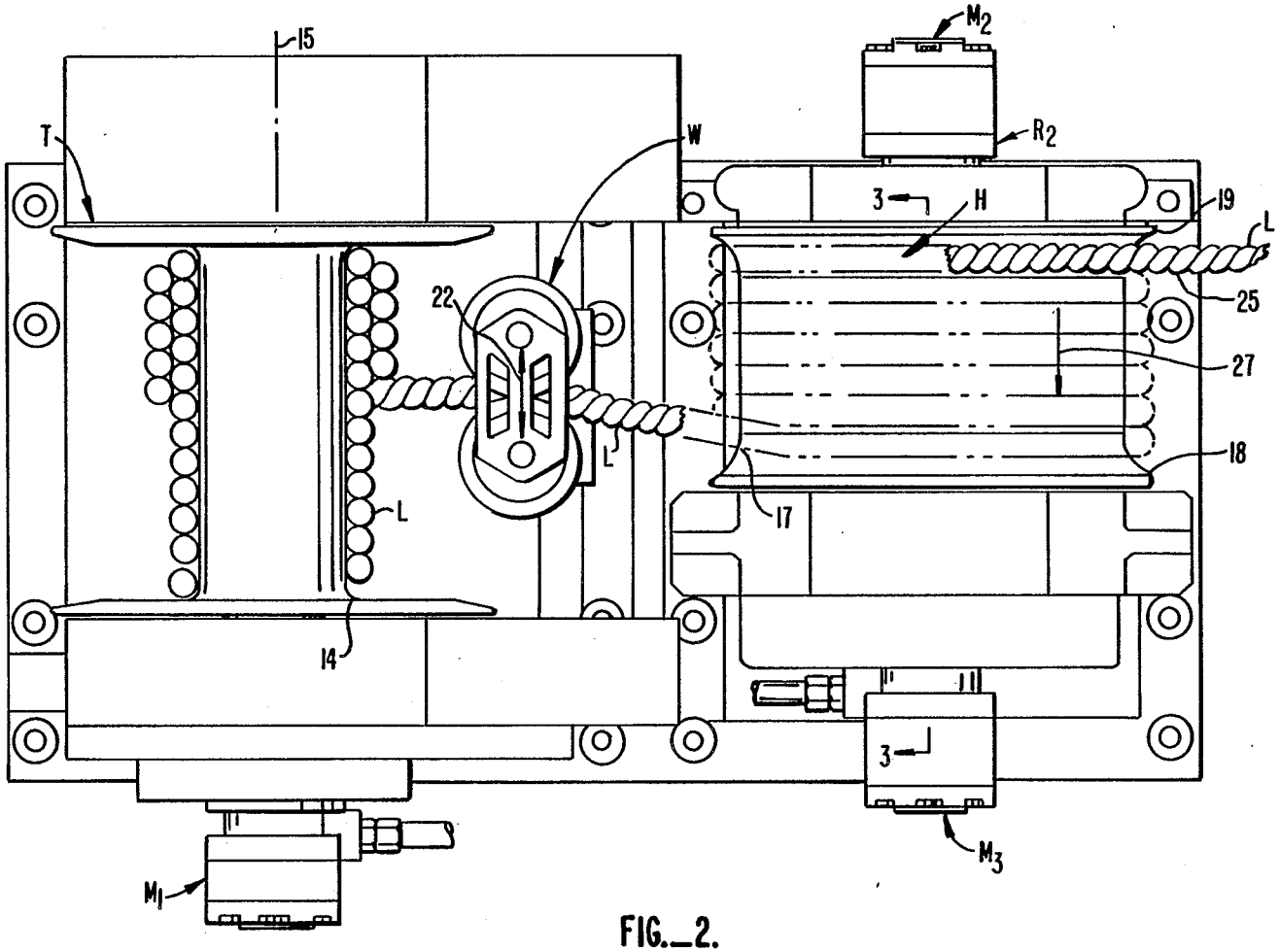
FIG. 2 is a plan view of the winch mechanism of FIG. 1 illustrating the high torque drum with line spirally wound and crowded across the drum with the output of the high torque drum feeding a level wind for line storage to the winding drum.

Referring to FIGS. 1 and 2, a base B mounts two drums; a winding drum T and a high torque drum H. Winding drum T accommodates the bitter end of a line at 14 and thereafter has the line helically disposed in successive layers about the axis 15 of the drum T. The line L passes between conventional level wind W to the high torque drum H at 17.

High torque drum H includes two surfaces 18 and 19 to induce climbing of the line L with respect to the drum. That is to say, utilizing the tension on the drum during line take-up the successive winds of the line L move from surface 19 towards surface 18 under urging of surface 19 during take-up. Conversely, and assuming that the line is being let go, the lines of line L move from surface 18 towards surface 19 when letting go of the line occurs.

Three hydraulic motors are provided. These motors are low torque hydraulic motor M1 on take-up drum T, medium torque hydraulic motor M2 and high torque hydraulic motor M3 on high torque drum H. Motor M1 keys directly to the shaft on take-up drum T. Motor M2 drives high torque drum H through conventional 4 to 1 gearing. High torque motor M3 communicates in a dual planetary gear drive relationship with respect to the shaft of high torque drum H as is disclosed with respect to FIG. 3.

Having set forth the discrete drums of the invention and the path of the line from load to bitter end, general operation of the winch will be described. General operation will first be described during rapid low tension line take-up and thereafter with respect to slow high tension take-up. Finally, letting go of the line will be set forth. Thereafter, the section of FIG. 3 will explain both the drive and the release of the drum with respect to high torque drum H. Finally, the hydraulic circuit be set forth with respect to FIG. 4.

It will be assumed that line L is initially slack. Motor M1 will drive take-up drum T at relatively high speed. Line tension up to 1,000 lbs. will cause line L gathered through level wind W to the surface of the take-up drum T. As is well known in the art, level wind W will make excursion back and forth in the direction of arrows 22 so that layer upon layer of line L is added to the take-up drum T. During the rapid line take-up motors M2, M3 will be idle. Further, high torque drum H will spin free of its respective drive on a ratchet R1 (to be later disclosed with respect to FIG. 3). Additionally, and just as motor M3 is provided with a ratchet R1, motor M2 is provided with a ratchet R2 (See FIG. 2).

Additionally, a ratchet 90 is placed adjacent the drive from motor M3. This ratchet assumes the load when motor M3 is not provided with hydraulic motive force and hence prevents the winch from backing under the full load of line L.

As the line L is drawn in, and the sail begins to tighten, the input oil pressure to motor M1 will rise. When it rises to a predetermined level, directly connected hydraulic motor M2 through conventional 4 to 1 ratcheted gearing will begin to power high torque winch H. At this time, both motors M1 and M2 will power the winches in series. Motor M1 will drive take-up drum T; motor M2 will drive high torque drum H.

When such series connected powering occurs, the function of take-up winch T will change. It will no longer be the primary motive force bringing the line L. Instead, it will supply what is known as a tailing force through level wind W to high torque winch H.

A tailing force is easy to understand. Specifically, the tension exerted on line L between level wind W and point 17 on high torque drum H acts as a line "tailing"

force. This line "tailing" force exerts a belt pulley type friction to the line over the successive turns provided on the high torque drum H. This force will be multiplied many times until full tension of the line is realized at point 25.

During take-up, high tension line L will first come in contact with the climbing cam surface 19. This contact will cause the successive winds of line around high torque winch H to move in the direction of arrow 27 to and towards climbing cam surface 18. Upon movement of the line to point 17, conventional discharge to the level wind W will occur.

During the high torque winding, the tension of the line seen at take-up drum T is substantially unchanged. That is to say, the line will accumulate on take-up drum T under constant tension. This being the case, there will not be the tendency of one high tensioned line to bury itself and fowl the remaining lines on the take-up drum T.

As the torque rises, the intake pressure on motor M2 will likewise rise. Finally, (and at a level of about 1500 psi) motor M3 will cause the line L to be taken in.

It will be understood that motor M3 through a gear train drives high torque drum H at approximately a 30 to 1 gear ratio. This being the case, great tension may be exerted at line L at point 25. During this phase, the tailing function of take-up drum T will still maintain substantially the same tension on the line L.

Upon tack of a vessel, release of line L must be accomplished. This is accomplished by releasing of conventional clutches on take-up drum T and release of the clutch designed within high torque drum H. Upon release of the paired clutches, a controlled release of the line L can occur.

Thus, it can be seen that the disclosed winch emulates the three line take-up functions of a modern high speed geared winch. Initial rapid line take-up is provided. Thereafter, and under a medium and controlled tension, slack is taken out of a sail. Finally, the sail is tightened to its ultimate "to weather" disposition.

Having set forth the overall functionality of the winch, attention can now be directed to the section setting forth the drive of the high torque drum H. The drive of motors M1 and M2 will be ignored; these motors are directly keyed to take-up drum T and high torque drum H.

Figure 3:
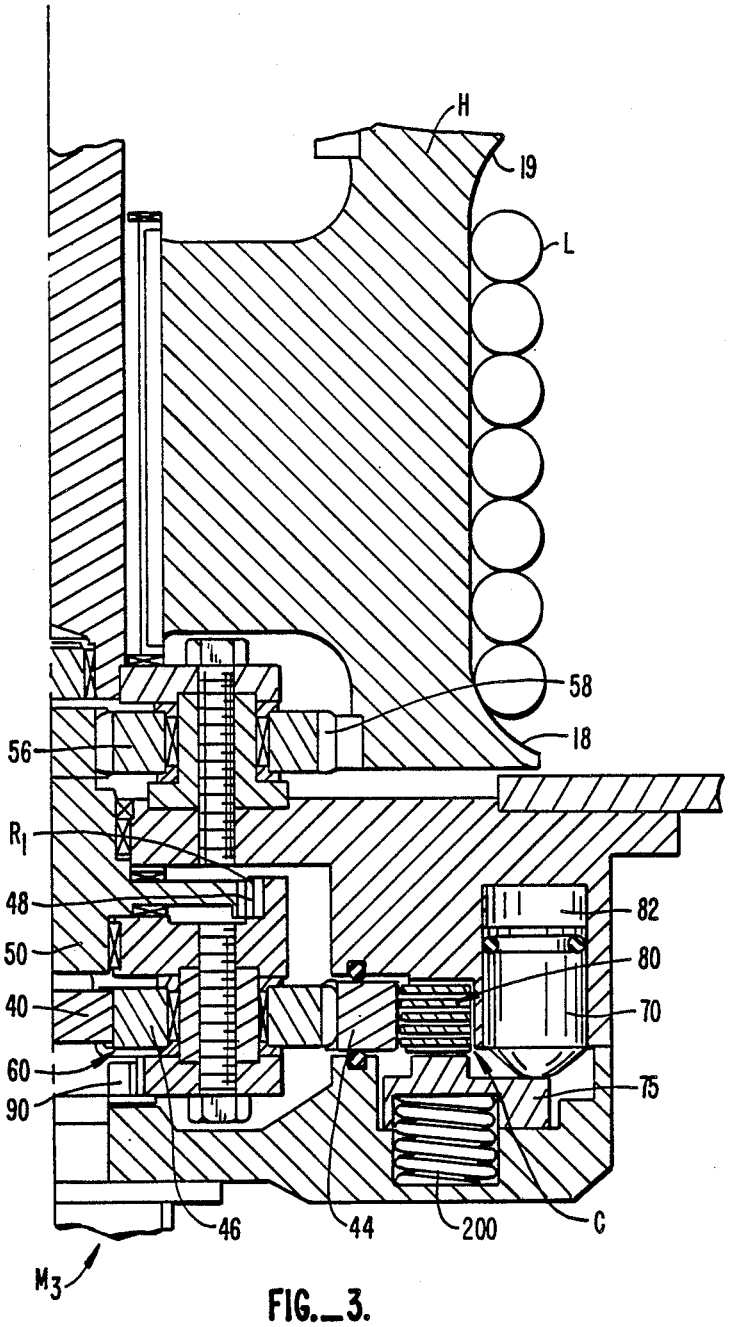
FIG. 3 is a side elevation section taken along the high torque drum, this section illustrating the dual planetary gear drive with ratchet, by a hydraulic motor drive and clutch for winch free wheeling, high torque rotation and line release; and, FIG. 4 is a schematic of a hydraulic circuit for the operation of the winch.

Referring to FIG. 3, drive from the motor M3 to the high torque drum H can be set forth. The reader will remember that this take-up is provided under high leverage.

Motor M3 inputs to an input sun gear 40. Input sun gear 40 rotates three planetary gears against a stationary outside ring 44. A representative planet gear 46 is illustrated intermediate the rotating sun gear and the stationary ring gear 44. As will hereinafter be developed, a clutch C is provided. Clutch C when relaxed allows stationary ring gear 44 to slip. Consequently release of the high torque drum H can occur.

With ring gear 44 held stationary and sun gear 44 rotating, gear 46 effects relative rotation with a 6 to 1 reduction. This 6 to 1 reduction compels planetary pinion carrier 48 to rotate a second sun gear 50. Second sun gear 50 in turns rotates a second planetary gear 56. Second planetary gear 56 is stationary. The second planetary gear 56 bears against a ring gear 58 on the inside of high torque drum H. This causes the high torque drum H to rotate under a gear ratio of approximately 30 to 1. Consequently, line L is brought in under high torque.

It is required that during the rapid gathering of the line, a ratchet R1 located at planetary gear carrier 48 enables high torque drum H to free wheel. Accordingly, a conventional ratchet is placed which allows the drum to be gathered in at a speed exceeding that of the motors M2, M3.

Release of clutch C is easily understood. A hydraulic piston 70 bears against a spring biased plate 75. Spring bias plate 75 in turn biases interleaved clutch plates 80 into the normally engaged position.

When disengagement is desired, piston 70 is provided with hydraulic force from within chamber 82. This hydraulic force advances the piston 70 against the spring bias plate 75. The frictional engagement between the clutch plates is released. Consequently, high torque drum H is free to release line under tension.

It will be understood that take-up drum T and its level wind W constitute a standard item of manufacture. Specifically, such a take-up drum T can be purchased from Seaway Products of Falmouth, England under the designation Captive Sheet Winch.

Take-up drum T is provided with a hydraulic brake. This take-up drum assures that the tension on line L remains uniform.

Figure 4:
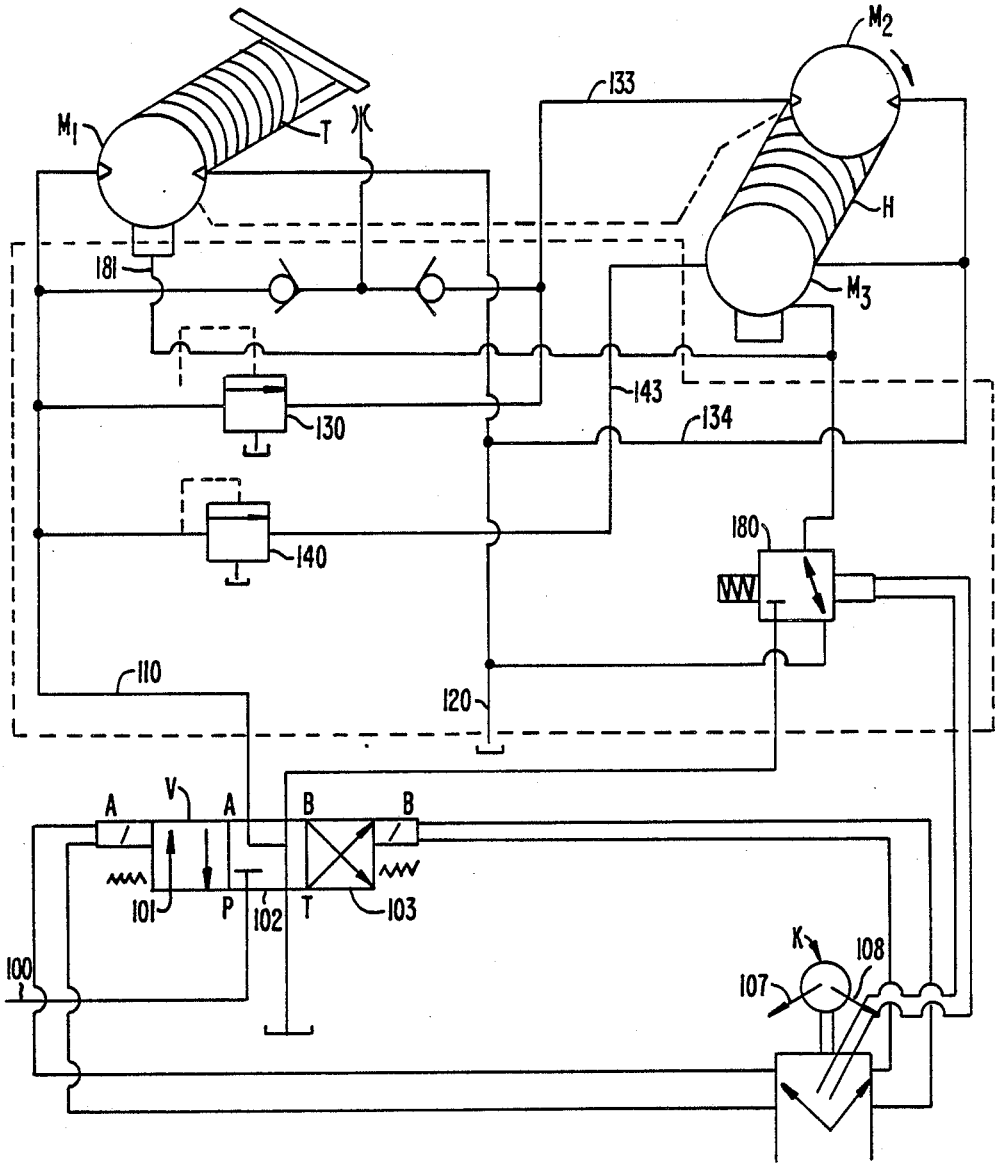

Referring to FIG. 4, the hydraulic circuit utilized with this invention can be illustrated. Conventional hydraulic power is provided at hydraulic line 100. Line 100 outputs continually to a three way valve V during winch operation. Three way valve V at first portion 101 provides for take-up of line. At portion 102, (the position illustrated) the hydraulic circuitry is idle. Tension at the winch will be maintained. At portion 103, the valve provides for proportional release. A control K acting on the valve supplies the respective positions of three way valve V and hence operation of the winch.

In the following description, normal take-up will be described first with the assumption being that valve portion 101 registers to the hydraulic line. Thereafter, release will be discussed with respect to valve portion 103.

The position of the three portioned valve V is illustrated at a manual control K. Control K functions to cause the valve to switch between any of its three positions.

Assuming that take-up is called for, the control K is moved forwardly in the direction of arrow 107. Hydraulic line 100 is registered with valve portion in three way valve 101 V.

Assuming initial registration, hydraulic force will pass through line 110 to hydraulic motor M1. Motor M1 will drive drum T with the resultant of output of low pressure hydraulic fluid to discharge 120.

As the torque rises on motor M1, its input pressure will rise. When the input exceeds 1200 psi, a sequence valve 130 will be overcome. Hydraulic fluid will then pass to motor M2 causing direct drive of high torque drum H in parallel with direct drive of winding drum T. Upon sequence of valve 130, line 133 will supply high pressure oil to motor M2 with line 134 exhausting the oil to drain 120.

When pressure exceeds 1500 psi, sequence valve 140 will be overcome. This will cause motor M3 to enter the series circuit. Entry into the motor drive will occur through line 143 with exhaust at line 134 to hydraulic discharge.

At this latter point, it will be seen that all three motors, M1, M2 and M3, will effectively be running in parallel.

It will also be understood that the tension on the line effectively controls the motors M1, M2 and M3 as they come on line. As tension increases, hydraulic shifting sequentially brings in parallel motors M2 and M3 to accompany the tailing force provided by motor M2. Thus it can be seen that the disclosed hydraulic circuit provides for motor operation.

Release of the clutch is easy to understand. Specifically, control K is moved in the direction of 108. This registers portion 103 of three way valve V to the active section of valve V. Hydraulic flow is provided to a proportional controller 170. Proportional controller 170 is conventional. Specifically, it causes the pressure in chamber 82 (see FIG. 3) to be proportionally increased dependent upon the position of handle K along path 108. This proportional controller allows hydraulic pressure to be increased to enable the clutch to slip.

It will be understood that spring bias 200 adjustment between the clutch on high torque winch H and the brake on winding drum T occurs. Preferably, the spring force on high torque winch H is adjusted for release after the brake on winding drum T. This enables the winding drum to release the line L under a conventional release of the belt pulley friction on the high torque drum. Such release is the same as the conventional "tailing" release usually manually accomplished on a manned winch on a sailing yacht.

When further hydraulic force is applied to the clutch, release of high torque winch H then occurs. This enables rapid, free wheeling movement of the drums and corresponding release of the line. (See clutches 180 and 181 on FIG. 4.)

The reader will understand that we have chosen to illustrate here a hydraulic circuit for sequencing the three motors. The reader should understand that the particular circuit we happen to illustrated here is not intended to restrict this invention. For example, the motors could as well be electric. Furthermore, mechanical drives with shifts could be as well utilized to accomplish the overall circuit herein set forth. What is intended to be set forth is the combination of both the take-up drum and the high torque drum to effect rapid line gathering in one mode with high torque slow speed gathering in the other mode. Further, both winch actions together enable line to be stored on the windup drum at substantially constant tension despite the widely varying loads encountered in the hauling in the sheet of a Genoa jib on a large sailboat.

Figure 5:
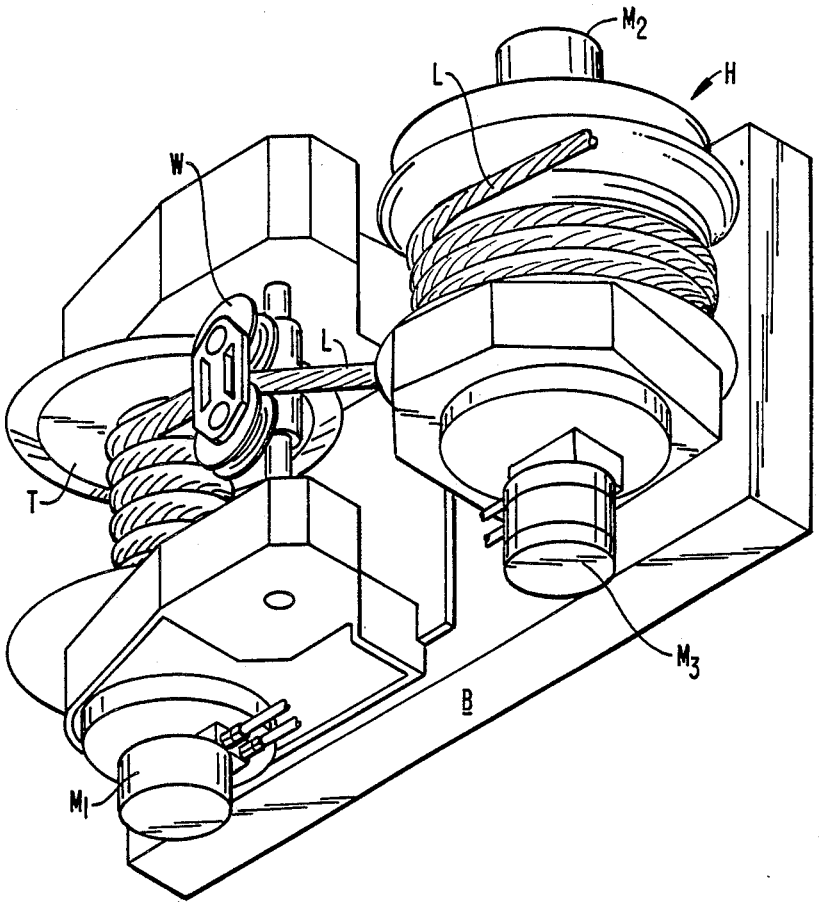
FIG. 5 is a perspective of the winch.

Referring to FIG. 5, the winch is illustrated in perspective. The series wind respective to the two drums T and H can easily be seen through the level wind W. The reader will, therefore, understand that the novel two winch construction has been illustrated. This construction is especially designed towards the needs of a modern large sailboat. Specifically provisioned for rapid line take-up under low tension and slow line take-up under high tension for the problem of hauling in sail is specifically disclosed.

What is claimed is:

1. A winch for bringing in a line having a load on one end with gathering of said line at the other end at high speed and low tension or slow speed and high tension, said winch comprising in combination:

a take-up drum;

said take-up drum attached to the end of said line, said take-up drum defining a reel with sufficient space for the storage of line thereon;

a level wind for feeding said line to said take-up drums;

a single high torque drum having said line wound continuously about said single high torque drum in multiple turns between said level wind to said take-up drum and a load on said line;

said single high torque drum having two end surfaces configured to induce climbing of said line at said multiple turns on said single high torque drum and defining a surface sufficiently smooth to permit climbing of said line at said multiple turns over the surface of said single high torque drum;

a first motor for driving said take-up drum;

a second motor for driving said single high torque drum;

ratchet means for permitting said single high torque drum to spin free of said second motor and feed the line to said take-up drum;

means for running said first motor at low line tension and said first and second motors at high line tension for permitting said take-up drum to take in said line at low line tension and said take-up drum to tail said single high torque drum at high line tension whereby said line can be brought in;

a clutch means operatively connected to said first and second drums for permitting the controlled release of said line.

2. The winch of claim 1 and wherein said means for running said first motor at low line tension and said first and second motors at high line tension includes a hydraulic circuit; said first motor being a hydraulic motor for driving said take-up drum;

a sequence valve connected in parallel with said hydraulic circuit to said first motor;

a second motor being a hydraulic motor;

said second motor connected to the hydraulic circuit through said sequence valve for driving said single high torque drum responsive to increased pressure at said first motor.

3. The invention of claim 1 and including a third motor connected to said single high torque drum; means for providing greater mechanical advantage between said third motor and said single high torque drum whereby said third motor can drive under greater mechanical advantage than said second motor to provide increased torque to said single high torque drum.

4. A winch for bringing in line having a load on one end with gathering of said line at the other end at high speed and low tension or slow speed and high tension, said winch comprising in combination; a take-up drum; said take-up drum attached to the end of said line, said take-up drum defining a reel with sufficient space for the storage of line thereon, a level wind for feeding line to said take-up drum for the placement of even layers of line on said drum;

a high torque drum having said line wound about said high torque drum between said level wind to said winding drum and a load on said line;

a first motor for driving said take-up drum;

a second motor for driving said high torque drum;

a third motor for indirectly driving said high torque drum, said third motor including gears rendering a mechanical advantage to the driving of said high torque drum;

ratchet means for permitting said high torque drum to spin free of said second and third motors and feed line directly to said take-up drum under tension from said take-up drum through said high torque drum;

sequence means for sensing tension on said line and sequentially connecting said first motor to power said take-up drum at low line tension, said first and second motors to power said take-up drum to tail said high torque drum at intermediate line pressures and powering said third motor to permit said high torque drum to exert maximum tension on said line;

clutch means keyed to said first and second drums for permitting the controlled release of said line.

5. The invention of claim 4 and wherein said high torque drum includes first and second series connected planetary gear trains; said clutch means connecting one of said gear trains with respect to said winch housing whereby said line may be rapidly released.

6. A winch for bringing in a line having a load on one end with gathering of said line at the other end at high speed and low tension or slow speed and high tension, said winch comprising in combination;

a take-up drum; said take-up drum threaded to the end of said line, said take-up drum defining a reel with sufficient space for the storage of line thereon; a level wind for the feeding of said line to said take-up drum;

a high torque drum having said line wound about said high torque drum between said level wind to said winding drum and load on said line;

a first hydraulic motor for driving said take-up drum;

a second hydraulic motor for driving said high torque drum;

a third hydraulic motor for driving said high torque drum under a mechanical advantage;

gear reduction means interconnecting said high torque drum and said third motor for enabling said third motor to rotate said high torque drum under mechanical advantage;

ratchet means for permitting said high torque drum to spin free of said second motor and feed line to said take-up drum;

hydraulic control means for running said first motor at low line tension, said first and second motors at intermediate line tension; and said first, second and third motors at high line tension, said hydraulic control means including;

means for outputting hydraulic fluid to said first motor;

a sequence valve for sensing the pressure of hydraulic input to said first motor whereby increasing line tension on said take-up drum produces increasing hydraulic pressure to said first motor, said sequence valve for sensing the input pressure to said first hydraulic motor and placing said second hydraulic motor in parallel operation with said first hydraulic motor upon sensing of a pressure in excess of a predetermined pressure at the inlet of said first hydraulic motor;

a second sequence valve, said second sequence valve operatively connected to sense the input pressure to said second hydraulic motor;

said second sequence valve operable to open upon sensing said preselected pressure to output hydraulic pressure to said third motor whereby all said motors run in parallel; and, clutch means operatively connected between said hydraulic circuit and said take-up drum and said high torque drum for the release of said drum and corresponding release of said line.

* * * * *